United States Patent [19]

Doobenen et al.

[11] 4,030,221

[45] June 21, 1977

[54] GUN LOCK USING MANUAL PRESSURE

[76] Inventors: William Doobenen, 6472 Camino Viviente, Goleta, Calif. 93017; Robert Thomas Hennessy, 932 N. Patterson, Santa Barbara, Calif. 93111

[22] Filed: Oct. 6, 1976

[21] Appl. No.: 730,125

[52] U.S. Cl. ..... 42/1 Y

[51] Int. Cl.[2] ..... F41C 27/10

[58] Field of Search ..... 42/1 Y, 1 LP

[56] References Cited

UNITED STATES PATENTS

| | | | |
|---|---|---|---|
| 1,887,308 | 11/1932 | Jessup | 42/1 Y |
| 2,444,649 | 7/1948 | Jacobs | 42/1 Y |

FOREIGN PATENTS OR APPLICATIONS

| | | | |
|---|---|---|---|
| 1,134,406 | 12/1956 | France | 42/1 Y |

*Primary Examiner*—Charles T. Jordan
*Attorney, Agent, or Firm*—Harry W. Brelsford

[57] ABSTRACT

A housing of U-shaped cross section fits over the trigger guard of a gun to cover the trigger guard and prevent access to the trigger. A latch member is disposed in the housing and is biased by an elastic member, for example, a spring, to engage the trigger guard. An external member is accessible from the outside of the housing for manual pressing to overcome the spring and thereby depress the latch for removing the housing from the trigger guard. By selecting the strength of the spring the gun can be rendered safe against children who have not enough strength to overcome the spring. Adults, however, can quickly remove the housing by manual pressure and make the gun instantly available for use.

7 Claims, 6 Drawing Figures

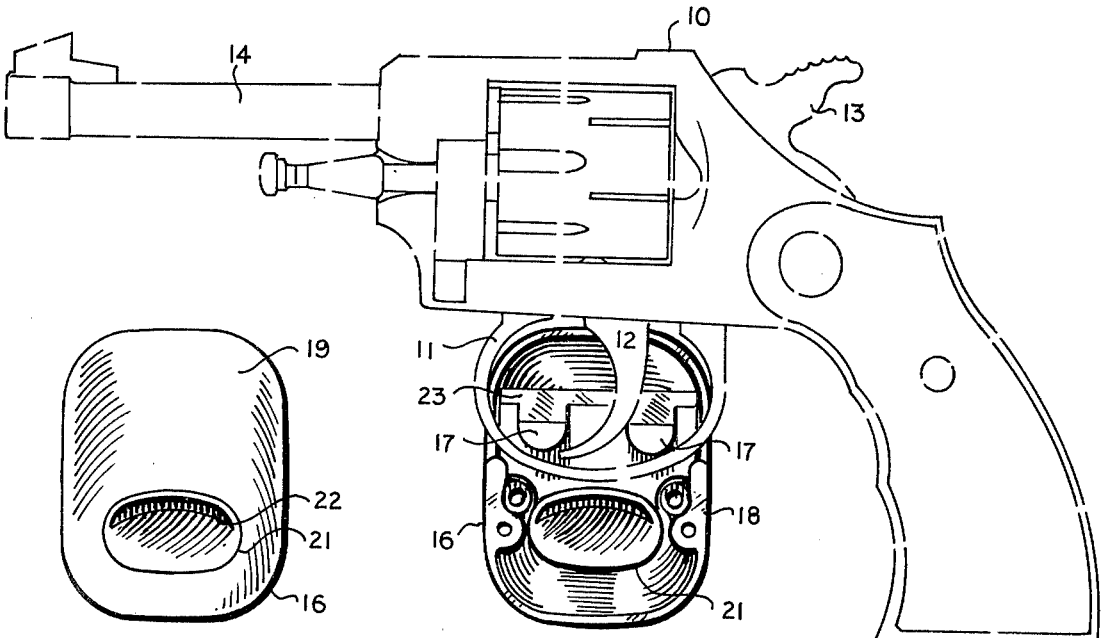
Fig. 1
Fig. 2
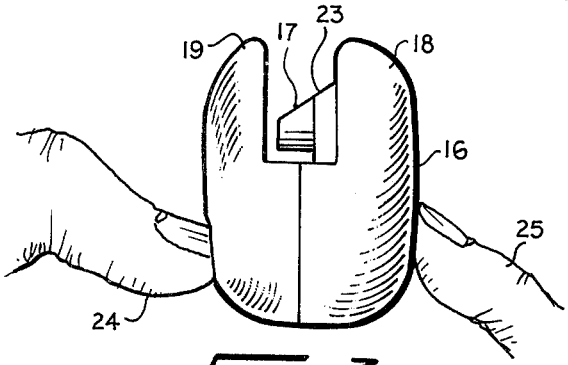
Fig. 3
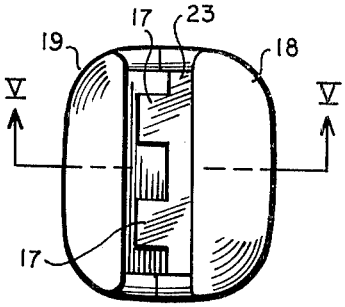
Fig. 4
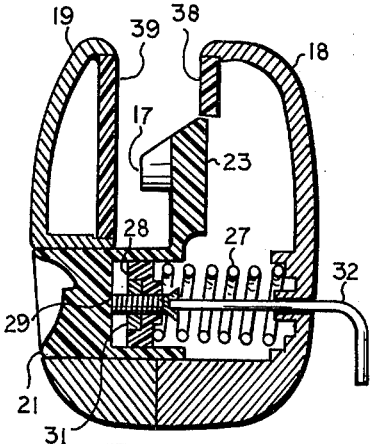
Fig. 5
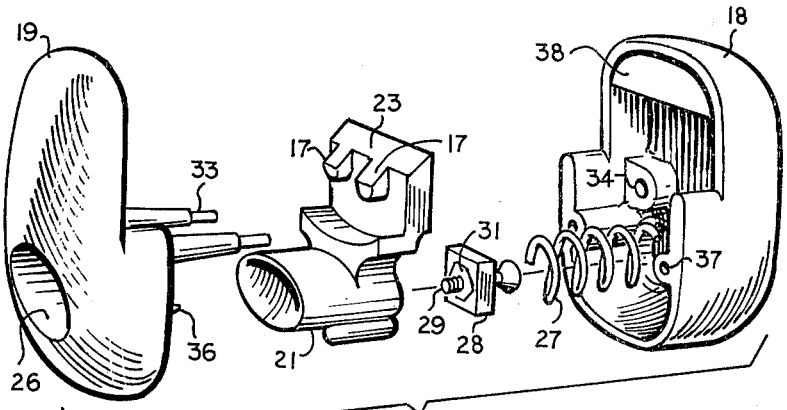
Fig. 6

GUN LOCK USING MANUAL PRESSURE

Our invention relates to safety locks for the triggers of guns and has particular reference to a lock that does not use keys, but instead uses the manual squeezing action of the humane hand to effect unlocking. The manual pressure overcomes a spring, the strength of which can be selected so that children are unable to manually overcome the spring but adults can quickly do so and make the gun available for use.

Many millions of households have handguns for personal protection, and on most of these households the guns are loaded for instant use. These loaded guns present a major safety problem is there are children in the home or if there are likely to be child visitors. The natural curiosity of children leads them to explore the various dressers, drawers, nightstands, and other places where loaded guns are frequently kept. The novelty of a real gun is often overwhelming, and children point these guns at each other or at other persons, frequently with tragic results.

Because of the hazards of children many gun owners seek to immobilize the gun with locks of various types. These generally take the form of a covering for the trigger of the handgun. While such locks are effective, they reduce the protective potential of the various revolvers and automatics, because they must be unlocked with a key. In the dark of night the key must be located and preferably it must be kept in a separate drawer or piece of furniture than the gun. The key must then be fitted in the dark into the lock and the lock removed before the gun is available for use. This cumbersome unlocking procedures has caused many people to forgo the safety of a lock and risk the hazards of accidents with children.

We have discovered that a very effective trigger lock for handguns can be made without the use of a key, combination, or other commonly accepted locking device. This is based upon our finding that the strength of the hands of children up to nine years of age is only a fraction of the strength of the hands of adults. We have discovered that a very effective lock against children is constructed by having a spring so strong that adults overcome the spring compression by the muscular force fo the adult hand, but children are unable to overcome it. The spring lock is merely pressed by the adult hand to enable the gun lock to be removed from the trigger guard of a handgun or other gun. While this could be done by having the fingertips press an object against the palm of the same hand, we presently prefer to use the hand pressure of the tip of the thumb pressing an object between the thumb tip and the fingertips.

In summary, we provide a housing which is fitted over the trigger guard of a handgun and which engages the trigger guard so that it cannot be removed except by overcoming the strength of a spring. The housing effectively prevents access to the trigger and thereby prevents accidental firing of the gun. The gun lock in its present configuration is also effective on double-action revolvers that have not been cocked. In order to cock the hammer of a double- action revolver, the hammer is manually pulled back, but this action also causes the trigger to move. We provide transverse lugs both in front of and behind the trigger of our trigger guard-enclosing housing. This stops the movement of the trigger and makes it impossible to cock the double-action revolver until the gun lock is removed. Our trigger guard not only covers the triggers and renders it inaccessible for all guns with trigger guards, but also for double-action revolvers preverts cocking of the handgun.

Various objects, advantages, and features of the invention will be apparent in the following description and claims, considered together with the accompanying drawings forming an integral part of this specification and in which:

FIG. 1 is an elevation view of a presently preferred embodiment of the invention.

FIG. 2 is an elevation view of a gun to which has been applied the gun lock of FIG. 1, but with part of the housing removed that faces the viewer in FIG. 1.

FIG. 3 is an end view of the gun lock of FIG. 1 showing lugs projecting into the U-shaped space between the parts of the housing.

FIG. 4 is a top view of the gun lock of FIG. 1 showing the lugs projecting into the U-shaped space between the housing members.

FIG. 5 is an elevation view taken along the line V—v of FIG. 4.

FIG. 6 is an exploded view of the gun lock of FIG. 1 showing the two housing halves with the latch and spring mechanism between them.

Referring to FIGS. 1 and 2, a gun 10 has trigger guard 11 in which is disposed a trigger 12 which releases a hammer 13, which in turn causes a bullet to pass through a barrel 14. Hanging on the interior of the oval-shaped trigger guard 11 is a gun lock 16, which engages the trigger guard 11 by virtue of a pair of lugs 17 resting on the trigger guard. These lugs are disposed in a two-part housing, one part 18 being shown in FIG. 2 and the other part closest to the viewer being shown in FIG. 1. Projecting through the outer housing 19 is a manual pressure member 21 adapted to be engaged by the thumb of the operator, and there is provided a crescent-shaped thumbnail slot 22 in this pressure member.

Referring to FIG. 3, it will be noted that the housing halves 18 and 19 define a generally U-shaped housing assembly, and the lugs 17 project into this opening in the U-shape. The lugs 17 are carried by a latch member 23. When an operator presses his thumb 24 against the pressure member 21 of FIG. 1 the latch 23 and its integral lugs 17 will be moved to the right as viewed in FIG. 3. When these lugs 17 clear the trigger guard 11 of FIG. 2 the entire gun lock assembly 16 may be removed from the gun 10.

Referring now to the exploded view, FIG. 6, the housing halves 18 and 19 are separated from each other for purposes of illustration, and mounted for reciprocation in the housing halves is the pressure member 21, which projects through a hole 26 in the housing 19. The latch 23 and its integral lugs 17 are formed integrally with the pressure member 21. The latch 23 is moved to the left by virture of a compression spring 27, one end of which bears on the housing half 18 and the other end of which bears against an adjuster pad 28, which transmits the spring pressure to an adjustment screw 29, the lefthand end of which bears against the latch member 23. The adjustment-bearing plate 28 may be threaded or may have an inserted nut 31 as desired.

Referring now to FIGS. 4 and 5, there is illustrated in FIG. 5 the adjustment mechanism for adjusting the compressive force of the spring 27. This is in the form of a suitable tool for rotating the adjustment screw 29, and there is illustrated an Allen-head wrench 32 engaging a suitable Allen socket in the screw 29. Rotation in one direction of the screw 29 will move the spring adjuster 28 to the right as shown in FIG. 5, causing the spring 27 to be compressed. This in turn increases the amount of pressure which the users thumb 24 of FIG. 3 must use in order to depress the latch 23 sufficiently so that the lugs 17 clear trigger guard 11 of FIG. 2. Any suitable tool that serves that purpose of a screwdriver can be used to effect the adjustment of the compression of thespring 27.

Referring now to FIG. 6, any suitable fasteners may be used to secure the two housing halves 18 and 19 together, and we presently prefer a pair of studs 33 on the housing half 19 passing through holes 34 in the housing half 18. These studs may be suitably peened over or engaged by a nut or any other suitable fastening technique may be used. To assist in the assembly the housing half 19 may have a pair of locator projections 36 engaging locator holes 37 in the housing half 18.

Referring to FIGS. 5 and 6, we have provided plates on the interior of the U-shape, which are of a non-scratching type so that the trigger guard 11 of the gun of FIG. 2 will not marred during use of the gun lock 16. Accordingly, we provide the housing half 18 with a cushion member 38 and provide the housing half 19 with a cusion member 39. These are preferably made of a hard plastic which is softer than steel and the bluing finish on steel and, accordingly, will not mar the metal of the trigger guard 11. The latch 23 and its integral pressure member 21 and lugs 17 may be formed also of a hard plastic, which must be a high-strength plastic so that the gun lock cannot be forcibly wrenched free from the gun 10 of FIG. 2.

OPERATION

To operate the gun lock a person grasps the lock 16 between his thumb 24 and fingertips 25 as illustrated in FIG. 3. By the application of a manual squeezing action, the pressure member 21 is depressed by the thumb 24 moving the integral latch 23 to the right as viewed in FIGS. 3, 4, 5, and 6. This causes the integral lugs 17 to move out of the oval enclosure of the trigger guard 11 of FIG. 2 so that the entire unit may then be moved downwardly and released from the gun 10. The gun is then ready for use. To lock the gun again, the same depressing action of the member 21 by the thumb 24 is used to move the lugs 17 to the right as viewed in FIGS. 3, 4, 5, and 6, whereupon the entire U-shape between the housing halves 18 and 19 is sufficiently clear to allow applying the gun lock 16 over the trigger guard as shown in FIG. 2. The thumb pressure is then released, and the lugs and their integral latch member 23 move to the left as viewed in FIG. 3 to ride on the interior of the oval trigger guard 11 as shown in FIG. 2. There it will be noted that the side- walls of the housing halves 18 and 19 substantially cover the entire trigger guard 11 so that access to the trigger 12 is prevented. If a child tries to depress the pressure member 21, he will not have enough strength even by using two hands to depress the spring 27. We have found that if the spring 27 is of such a strength that a pressure of eight to eleven kilograms (eighteen to twenty-five pounds) is required to sufficiently depress the latch 23 to remove the lock from the trigger guard 11, then a child of the age of 9 or younger does not have sufficient strength to exert this type of pressure with the thumb tip, even using two hands.

It it is desired to make the gun proof against children of even a greater age the Allen-head wrench 32 of FIG. 5 may be rotated to compress the spring 27 by moving the spring adjustment plate 28 to the right as viewed in FIG. 5. Then even pressure will be required by the user to depress the pressure member sufficiently for this release.

The structure of the lugs 17 as shown in FIG. 2 is such that the device will not only prevent operating the trigger, but will also prevent cocking the hammer 13 of the double-action revolver. In such a cocking action the trigger moves in unison with the cocking of the hammer 13, but the righthand lug 17 of FIG. 2 prevents the trigger 12 from moving to the rear or to the right as viewed in FIG. 2. Accordingly, the gun cannot even be cocked, much less the trigger pulled. If it is desired on any type of gun to prevent any movement of the trigger, for example, by pulling the entire lock 16 to the right as shown in FIG. 2, then the lug 17 may be custom-designed so as to fit the entire space between the right-hand edge of the trigger 12 and the interior of the trigger guard 11 on the right of the trigger 12. Then there can be no movement of any type of the trigger 12. With double-action guns, however, in an uncocked position the gun lock 16 is 100% effective in the form shown in FIG. 2.

It will be appreciated by those skilled in the art that the invention may take various forms. For example, the pressure member 21 may normally project a substantial distance outside the housing 19, in which case it may be squeezed by pressure between the fingertips 25 and the palm of a user's hand. Furthermore the latch mechanism instead of being reciprocating could be hinged to one of the housing halves. Instead of projecting lugs a bottom edge of the latch itself could engage the interior of the oval-shaped trigger guard 11 to keep the gun lock in place. The latch and the pressure member may be mechanically separate. Any suitable adjustment may be used for changing the compression of the spring. The spring may be in the form of a pneumatic piston-cylinder of a flexible pneumatic capsule or rubber.

While we have described our gun lock with respect to a presently preferred embodiment thereof, we do not limit ourselves to the embodiment illustrated, but include within the scope of the following claims all variations and modifications thereof that fall within the true spirit and scope of the invention.

We claim:

1. A gun lock for guns having a trigger guard in a plane and having a trigger disposed within the trigger guard, comprising:

a. a housing of U-shaped cross section having a spacing between the legs of the U-shape to fit over the trigger guard and having sidewalls extending parallel to the plane of the guard to cover the trigger;

b. a latch disposed in the housing for movement in a direction transverse to the plane of the trigger guard and having a part projecting into the U-shape of the housing upon movement of the latch toward the opening of the U-shape;

c. a spring in said housing engaging the latch and urging said latch in a direction to cause said part normally to engage the trigger guard;

d. and a manual pressure member at one sidewall of the housing to be manually squeezed to overcome the spring to move the latch so that the guard engaging part is sufficiently retracted to allow removal of the entire trigger lock from the trigger guard, to thereby protect the trigger from persons of insufficient strength to retract the latch from the trigger guard.

2. A gun lock as set forth in claim 1 wherein the spring strength is selected so that the latch part can be moved from contact with the guard only by a manual force within the average range of adults.

3. A gun lock as set forth in claim 1 wherein a spring adjuster is provided to adjust the spring to require different amounts of manual pressure to move the latch part from engagement with the trigger guard.

4. A gun lock as set forth in claim 1 wherein the latch part is located at the rear of the trigger and is of sufficient size to prevent rearward movement of the trigger, to thereby prevent cocking of a double-action revolver upon which the lock may be placed.

5. A gun lock as set forth in claim 1 wherein the inner walls of the U-shape of the housing are formed of cushion material to aviod scratching the trigger guard.

6. A gun lock as set forth in claim 1 wherein the latch is made of a nonscratching material to avoid scratching the material of the trigger guard and trigger.

7. A gun lock as set forth in claim 1 wherein the latch reciprocates transversely to the plane of the trigger guard.

* * * * *